US011208599B2

(12) United States Patent
Alarifi et al.

(10) Patent No.: US 11,208,599 B2
(45) Date of Patent: Dec. 28, 2021

(54) PROCESS FOR CATALYTIC CRACKING OF NAPHTHA USING RADIAL FLOW MOVING BED REACTOR SYSTEM

(71) Applicant: SABIC Global Technologies B.V., Bergen op Zoom (NL)

(72) Inventors: Abdulaziz S. Alarifi, Riyadh (SA); Khalid A. Al-Majnouni, Riyadh (SA); Ahmed Al-Zenaidi, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 39 days.

(21) Appl. No.: 16/604,235

(22) PCT Filed: Mar. 13, 2018

(86) PCT No.: PCT/IB2018/051672
§ 371 (c)(1),
(2) Date: Oct. 10, 2019

(87) PCT Pub. No.: WO2018/207033
PCT Pub. Date: Nov. 15, 2018

(65) Prior Publication Data

US 2020/0157435 A1 May 21, 2020

Related U.S. Application Data

(60) Provisional application No. 62/504,273, filed on May 10, 2017.

(51) Int. Cl.
*C10G 11/16* (2006.01)

(52) U.S. Cl.
CPC ..... *C10G 11/16* (2013.01); *C10G 2300/1051* (2013.01); *C10G 2300/1055* (2013.01);
(Continued)

(58) Field of Classification Search
CPC ..... C10G 11/16; C10G 2300/1048; C10G 2300/1051; C10G 2300/1055;
(Continued)

(56) References Cited

U.S. PATENT DOCUMENTS 3,706,536 A 12/1972 Greenwood et al. ..... 23/288 G
4,102,776 A 7/1978 Stone ..... 208/64
(Continued)

FOREIGN PATENT DOCUMENTS

CN 1003 92047 C 6/2008
CN 100554229 C 10/2009
(Continued)

OTHER PUBLICATIONS

Gary, J.H. et al. (2007) Petroleum Refining Technology and Economics, 5th edition, Taylor & Francis, 463 pgs [Office action cites section 17.10].*

(Continued)

*Primary Examiner* — Brian A McCaig
(74) *Attorney, Agent, or Firm* — Norton Rose Fulbright US LLP

(57) ABSTRACT

A method of catalytically cracking liquid hydrocarbons is disclosed. The method includes the use of one or more radial flow moving bed reactors. The method may include mixing a liquid hydrocarbon stream comprising primarily C5 and C6 hydrocarbons with water or a dry gas to form a feed mixture and flowing the feed mixture into the one or more radial flow moving bed reactors in a manner so that the feed mixture flows radially inward or radially outward through the moving catalyst bed and thereby contacts the catalyst particles under reaction conditions to produce a hydrocarbon stream comprising light olefins (C2 to C4 olefins).

20 Claims, 4 Drawing Sheets

(52) U.S. Cl.
CPC ..... *C10G 2300/1092* (2013.01); *C10G 2300/4006* (2013.01); *C10G 2300/4018* (2013.01); *C10G 2300/701* (2013.01)

(58) Field of Classification Search
CPC .... C10G 2300/1092; C10G 2300/4006; C10G 2300/4018; C10G 2300/70; C10G 2300/701
See application file for complete search history.

(56) References Cited

U.S. PATENT DOCUMENTS

| | | | | |
|---|---|---|---|---|
| 4,110,081 | A * | 8/1978 | Millar | B01J 8/003 208/165 |
| 4,830,728 | A | 5/1989 | Herbst et al. | 208/78 |
| 6,437,208 | B1 | 8/2002 | Kuechler et al. | 585/640 |
| 8,293,961 | B2 | 10/2012 | Choi et al. | 585/651 |
| 8,324,441 | B2 | 12/2012 | Wegerer et al. | 585/648 |
| 2001/0056217 | A1 * | 12/2001 | Froment | B01J 29/405 585/653 |
| 2005/0096492 | A1 | 5/2005 | Dath et al. | 585/653 |
| 2009/0110616 | A1 | 4/2009 | Yuan | 422/216 |
| 2010/0087693 | A1 | 4/2010 | Kalnes et al. | 585/315 |
| 2011/0152591 | A1 | 6/2011 | Sadler et al. | 585/313 |
| 2013/0338418 | A1 | 12/2013 | Xu et al. | 585/400 |
| 2017/0173549 | A1 | 6/2017 | Bazer-Bachi et al. | |

FOREIGN PATENT DOCUMENTS

| | | | |
|---|---|---|---|
| CN | 102746081 | B | 11/2014 |
| EP | 2660288 | A1 | 11/2013 |
| JP | H10251664 | A | 9/1998 |
| WO | WO2002028987 | A1 | 4/2002 |
| WO | WO2006098712 | A1 | 9/2006 |
| WO | WO2006124175 | | 11/2006 |
| WO | WO2008008527 | | 1/2008 |
| WO | WO2013016660 | A1 | 1/2013 |
| WO | WO2018109639 | A1 | 6/2018 |

OTHER PUBLICATIONS

International Search Report and Written Opinion from PCT/IB2019/055646 dated Sep. 25, 2019, 10 pages.
"Unconventional Catalytic Olefins Production: Commercial Vision and Breakout?" The Catalyst Group Resources, 19 Pages, 2013.
Bayat et al. "Enhanced olefin production via a novel radial-flow membrane reactor of heavy paraffin dehydrogenation in LAB plant." Journal of the Taiwan Institute of Chemical Engineers 45 (2014) 2906-2919.
Bulatov et al., "FCC Process of Heavy Feed Stock with Improved Yield of Light Olefins", Oil and Gas Business, 10 pages, 2009.
International Search Report and Written Opinion from PCT/IB2018/051672 dated May 17, 2018, 9 pages.

* cited by examiner

PROCESS FOR CATALYTIC CRACKING OF NAPHTHA USING RADIAL FLOW MOVING BED REACTOR SYSTEM

CROSS REFERENCE TO RELATED APPLICATIONS

This application is a national phase application under 35 U.S.C. § 371 of International Application No. PCT/IB2018/051672 filed Mar. 13, 2018, which claims priority to U.S. Provisional Patent Application No. 62/504,273 filed May 10, 2017. The entire contents of each of the above-referenced disclosures is specifically incorporated by reference herein without disclaimer.

FIELD OF INVENTION

The present invention generally relates to the production of light olefins.

More specifically, the present invention relates to the catalytic cracking of liquid hydrocarbons to form light olefins.

BACKGROUND OF THE INVENTION

Distilling crude oil to produce products such as butane (or lighter hydrocarbons), straight run gasoline, naphtha, kerosene, light gas oil, heavy gas oil, and straight run residue is simply separating the crude oil into its various constituents. Thus, under set processing conditions, the relative proportions of the products produced from a particular type of crude oil will roughly remain constant. However, based on market demands, it may be more economical to be able to increase the proportion of one or more of the products at the expense of other products. For example, when the demand for gasoline is high, it may be more economical to produce more gasoline than heavy gas oil. Thus, processes have been developed to convert one type of distilled product to another. One such process is catalytic cracking, where longer and heavier hydrocarbon molecules are contacted with a catalyst at high temperatures and pressures to break them into lighter and shorter hydrocarbon molecules.

One type of catalytic cracking process involves the conversion of paraffinic hydrocarbons having end point <350° C. into light olefins (e.g., $C_2$ and $C_3$ hydrocarbons). However, carrying out this conversion with high selectively and high yields poses a challenge from both process configuration and catalyst design standpoints. The conversion of paraffinic hydrocarbons having end point <350° C. into light olefins requires high temperature (above 600° C.) and relatively short residence time to overcome the endothermicity of the reactions and prevent oligomerization of the light olefins. In addition, at such high temperature, catalyst deactivation is problematic; specifically, catalysts in this process deactivate more frequently than some other catalytic processes. Catalyst deactivation is caused by coke formation and structural damage of the catalyst caused, at least in part, by high temperatures.

One commercial process for converting naphtha feed into light olefins was jointly developed by KBR and SK cooperation. The technology is called Advanced Catalytic Olefins (ACO™) and is based on a fluid catalytic cracking process where catalysts are circulated between reactor and regenerator. This process is most applicable when the catalyst deactivates rapidly. The process suffers from heat imbalance when paraffinic feed is used. The amount of coke is not enough to sustain the energy balance. In addition, the process requires high catalyst/oil ratio in order to have acceptable yields and requires continuous catalyst make up as a result of rapid loss of catalyst activity. In the ACO™ process, yields per pass are relatively low compared to a fixed bed process because of the short residence time of the process.

BRIEF SUMMARY OF THE INVENTION

A discovery has been made of a process that addresses the foregoing problems associated with the catalytic cracking of hydrocarbons to form light olefins. Embodiments of the discovered process involve utilizing one or more reaction stages, where the one or more reaction stages include one or more radial flow moving-bed reactors with continual catalyst regeneration. According to embodiments of the invention, the catalyst moves slowly by gravity, from the top of the reactor(s) toward the bottom of the reactor(s), and then deactivated catalyst is withdrawn and sent to a regenerator to burn off coke.

Embodiments of the invention include a method of catalytically cracking liquid hydrocarbons. The method may include adding catalyst particles to a catalyst entry location of a radial flow moving bed reactor and allowing the catalyst particles to move by gravity through the radial flow moving bed reactor to an exit location of the radial flow moving bed reactor. The catalyst particles form a moving catalyst bed in the radial flow moving bed reactor. The method may further include mixing a liquid hydrocarbon stream that includes primarily $C_5$ and $C_6$ hydrocarbons with water or a dry gas to form a feed mixture and flowing the feed mixture into the radial flow moving bed reactor in a manner so that the feed mixture flows radially inward or radially outward through the moving catalyst bed and thereby contacts the catalyst particles under reaction conditions to produce a hydrocarbon stream comprising light olefins ($C_2$ to $C_4$ olefins). The method may further include flowing the hydrocarbon stream comprising light olefins from the radial flow moving bed reactor.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refers to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, includes any measurable decrease or complete inhibition to achieve a desired result.

The term "effective," as that term is used in the specification and/or claims, means adequate to accomplish a desired, expected, or intended result.

The term "primarily" means greater than 50%, e.g., 50.01-100%, or any range between, e.g., 51-95%, 75%-90%, at least 60%, at least 70%, at least 80% etc.

The use of the words "a" or "an" when used in conjunction with the term "comprising," "including," "containing,"

or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

In the context of the present invention twenty embodiments are now described. Embodiment 1 is a method of catalytically cracking liquid hydrocarbons. The method includes the steps of adding catalyst particles to a catalyst entry location of a radial flow moving bed reactor; allowing the catalyst particles to move by gravity through the radial flow moving bed reactor to an exit location of the radial flow moving bed reactor, wherein the catalyst particles form a moving catalyst bed in the radial flow moving bed reactor; mixing a liquid hydrocarbon stream containing primarily $C_5$ and $C_6$ hydrocarbons with water or a dry gas to form a feed mixture; flowing the feed mixture into the radial flow moving bed reactor in a manner so that the feed mixture flows radially inward or radially outward through the moving catalyst bed and thereby contact the catalyst particles under reaction conditions to produce a hydrocarbon stream containing light olefins ($C_2$ to $C_4$ olefins); and flowing the hydrocarbon stream containing light olefins primarily $C_2$ and $C_3$ hydrocarbons from the radial flow moving bed reactor. Embodiment 2 is the method of embodiment 1, further including the steps of flowing spent catalyst from the radial flow moving bed reactor to a catalyst regenerator; regenerating the spent catalyst in the catalyst regenerator; and flowing regenerated catalyst from the catalyst regenerator to the radial flow moving bed reactor via the catalyst entry location. Embodiment 3 is the method of any of embodiments 1 and 2, wherein the dry gas contains at least one member selected from the group consisting of: methane ($CH_4$), hydrogen ($H_2$), and combinations thereof. Embodiment 4 is the method of any of embodiments 1 to 3, wherein flowing the feed mixture radially inward or radially outward causes the flow of the feed mixture to be perpendicular or substantially perpendicular to movement of the catalyst bed. Embodiment 5 is the method of any of embodiments 1 to 4, wherein the liquid hydrocarbon stream has an end point of less than 350° C. Embodiment 6 is the method of any of embodiments 1 to 5, wherein the reaction conditions include a weight hourly space velocity (WHSV) in a range 1 to 15 $hr^{-1}$, preferably from 2 to 10 $hr^{-1}$ and more preferably from 4 to 9 $hr^{-1}$. Embodiment 7 is the method of any of embodiments 1 to 6, wherein the reaction conditions include a reaction temperature in a range 450 to 900° C., preferably from 530 to 800° C. and more preferably from 580 to 750° C. Embodiment 8 the method of any of embodiments 1 to 7, wherein the reaction conditions include a pressure in a range vacuum to 10 bars. Embodiment 9 is the method of any of embodiments 1 to 8, wherein the liquid hydrocarbon stream contains at least one member selected from the group consisting of light naphtha, heavy naphtha, kerosene and diesel. Embodiment 10 is the method of any of embodiments 1 to 9, further including the step of recycling uncracked $C_5$ and $C_6$ hydrocarbons back to the radial flow moving bed reactor. Embodiment 11 is the method of any of embodiments 1 to 10, wherein water/liquid hydrocarbon stream volumetric ratio is in the range 0 to 10.

Embodiment 12 is a method of catalytically cracking liquid hydrocarbons. This method includes the steps of processing a feed stream containing paraffinic $C_5$ and $C_6$ hydrocarbons mixed in a series of radial flow moving bed reactors, wherein processing in a first radial flow moving bed reactor in the series of radial flow moving bed reactors includes adding catalyst particles to a catalyst entry location of the first radial flow moving bed reactor; allowing the catalyst particles to move by gravity through the first radial flow moving bed reactor to an exit location of the first radial flow moving bed reactor, wherein the catalyst particles form a first moving catalyst bed in the first radial flow moving bed reactor; mixing the feed stream with water or dry gas to form a feed mixture; flowing the feed mixture into the first radial flow moving bed reactor in a manner so that the feed mixture flows radially inward or radially outward through the first moving catalyst bed and thereby contact the catalyst particles under reaction conditions to produce a first hydrocarbon effluent stream containing light olefins ($C_2$ to $C_4$ olefins); flowing the first hydrocarbon effluent stream into a second radial flow moving bed reactor of the series of radial flow moving bed reactors for further processing; flowing spent catalyst from the series of radial flow moving bed reactors to a catalyst regenerator; regenerating the spent catalyst in the catalyst regenerator; and flowing regenerated catalyst from the catalyst regenerator to the series of radial flow moving bed reactors. Embodiment 13 is the method of embodiment 12, wherein the series of radial flow moving bed reactors includes 2 to 7 radial flow moving bed reactors arranged in series. Embodiment 14 is the method of any of embodiments 12 and 13, wherein each reactor in the series of radial flow moving bed reactors, other than the first radial flow moving bed reactor in the series, receives an effluent stream from the prior reactor in the series and processes an effluent stream from the prior reactor in the series to produce an effluent stream containing more light olefins than the effluent stream from the prior reactor in the series. Embodiment 15 is the method of any of embodiments 12 to 14, wherein radial flow moving bed reactors in series after the first radial flow moving bed reactor (subsequent reactors) is adapted to operate so that influent for each of the subsequent reactors flows radially inward or radially outward through the each of the subsequent reactors and thereby contact the catalyst particles under reaction conditions to produce a hydrocarbon effluent stream containing more light olefins than the effluent stream from the prior reactor in the series. Embodiment 16 is the method of any of embodiments 12 to 15, wherein one or more of the radial flow moving bed reactors contain a catalyst different from a catalyst in the other radial flow moving bed reactors. Embodiment 17 is the method of any of embodiments 12 to 16, wherein the dry gas comprises at least one member selected from the group consisting of methane ($CH_4$) and hydrogen ($H_2$). Embodiment 18 is the method of any of embodiments 12 to 17, wherein flowing the feed mixture radially inward or radially outward causes the flow of the feed mixture to be perpendicular or substantially perpendicular to movement of the catalyst bed. Embodiment 19 is the method of any of embodiments 12 to 18, wherein the feed stream contains a liquid hydrocarbon stream that has an end point of less than 350° C. and at least one of the reactors in the series operate under reaction conditions that include at least one member from the group consisting of: (1) a weight hourly space velocity (WHSV) in a range from 1 to 15 $hr^{-1}$, preferably from 2 to 10 $hr^{-1}$ and more preferably from 4 to 9 $hr^{-1}$, (2)

a reaction temperature in a range 450 to 900° C., preferably from 530 to 800° C. and more preferably from 580 to 750° C., (3) a pressure in a range of vacuum to 10 bars. Embodiment 20 is the method of embodiment 19, wherein the feed stream contains at least one member selected from the group consisting of light naphtha, heavy naphtha, kerosene and diesel.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which.

DETAILED DESCRIPTION OF THE INVENTION

A discovery has been made of a process that addresses existing problems associated with the catalytic cracking of hydrocarbons to form light olefins. Embodiments of the discovered process involve utilizing one or more reaction stages, where the one or more reaction stages include one or more radial flow moving-bed reactors with continual catalyst regeneration. According to embodiments of the invention, the catalyst moves slowly by gravity, from the top of the reactor(s) toward the bottom of the reactor(s), and then deactivated catalyst is withdrawn and sent to a regenerator to burn off coke.

Embodiments of the invention include a method of catalytically cracking liquid hydrocarbons, e.g., naphtha stream. The method may include adding catalyst particles (e.g., of a zeolite catalyst) to a catalyst entry location of a radial flow moving bed reactor and allowing the catalyst particles to move by gravity through the radial flow moving bed reactor to an exit location of the radial flow moving bed reactor. The slowly moving catalyst particles form a moving catalyst bed in the radial flow moving bed reactor. The method may further include mixing a liquid hydrocarbon stream that includes primarily $C_5$ and $C_6$ hydrocarbons with water or dry gas (e.g., an inert gas) to form a feed mixture and flowing the feed mixture into the radial flow moving bed reactor in a manner so that the feed mixture flows radially inward or radially outward through the moving catalyst bed and thereby contacts the catalyst particles under reaction conditions to produce a hydrocarbon stream that includes light olefins ($C_2$ to $C_4$ olefins). In embodiments of the invention, the hydrocarbon stream may include primarily light olefins. The method may further include flowing the hydrocarbon stream that includes light olefins from the radial flow moving bed reactor.

Figure 1:
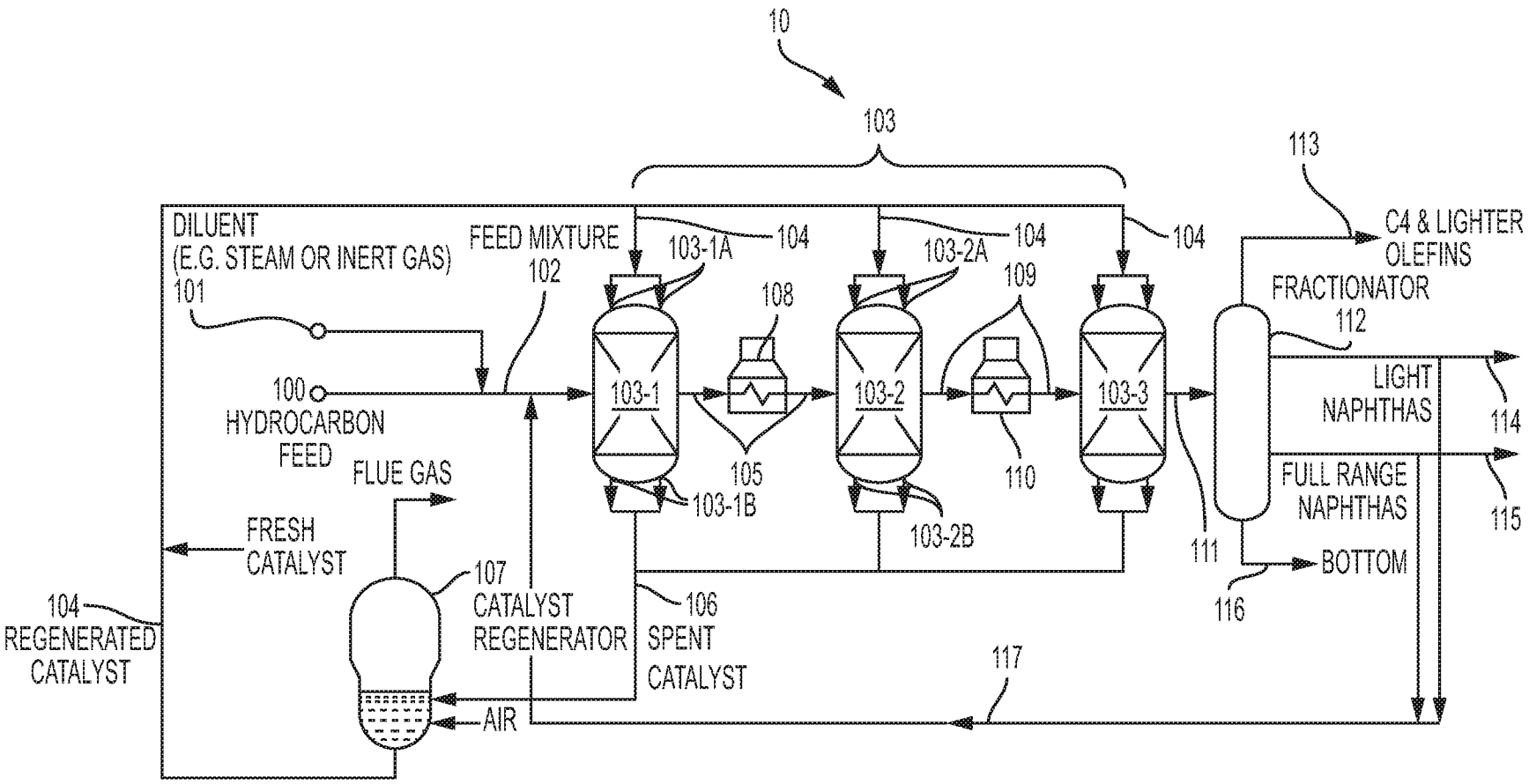
FIG. 1 shows a system for producing light olefins by a catalytic cracking process, according to embodiments of the invention.
Figure 2:
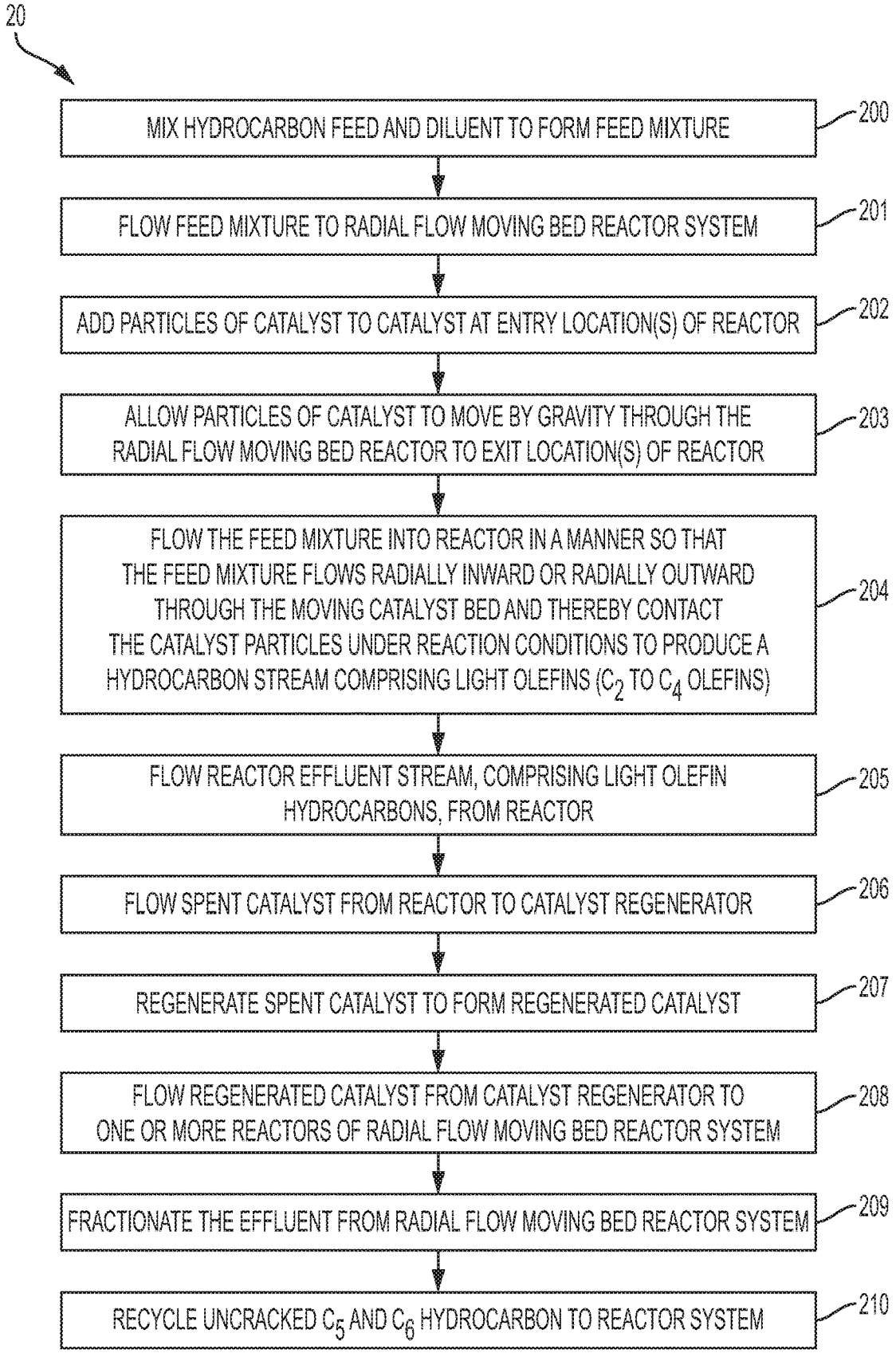
FIG. 2 shows a method of producing light olefins by a catalytic cracking process, according to embodiments of the invention.

FIG. 1 shows system 10 for producing light olefins by a catalytic cracking process, according to embodiments of the invention. FIG. 2 shows method 20 for producing olefins by a catalytic cracking process, according to embodiments of the invention. Method 20 may be implemented by system 10 to continuously catalytically crack liquid hydrocarbons, such as naphtha, using one or more radial flow moving bed reactors. In operation of system 10 to implement method 20, hydrocarbon feed 100 may be supplied to system 10 from other refinery processes such as distillation processes. Hydrocarbon feed 100 may include one or more liquid streams of light naphtha, heavy naphtha, kerosene, diesel or combinations thereof. Hydrocarbon feed 100 may comprise primarily paraffins. In embodiments of the invention, hydrocarbon feed 100 has an end point of less than 350° C.

In embodiments of the invention, in addition to hydrocarbon feed 100, diluent 101 (e.g., steam or dry gas) may be supplied to system 10. In embodiments of the invention, diluent 101 may originate from other refinery processes. In embodiments of the invention, dry gas forming diluent 101 may include one or more of methane, ethane, hydrogen, propane, or ethylene. In embodiments of the invention, diluent 101 may include methane and/or hydrogen.

With hydrocarbon feed 100 and diluent 101 supplied to system 10, method 20, as implemented by system 10, may include mixing hydrocarbon feed 100 and diluent 101 to form feed mixture 102, at block 200. Hydrocarbon feed 100 may include primarily $C_5$ and $C_6$ hydrocarbons. As discussed further below certain streams from system 10 may be recycled to be mixed with feed mixture 102 and fed to reactor 103-1. At block 201 of method 20, feed mixture 102 is flowed to radial flow moving bed reactor system 103. Radial flow moving bed reactor system 103 may include one or more radial flow moving bed reactors arranged in series or parallel for cracking feed mixture 102 to form light olefins. FIG. 1 shows radial flow moving bed reactor system 103 having three reactors (reactor 103-1, reactor 103-2, and reactor 103-3). Embodiments of the invention, however, are not limited to three reactors. For example, embodiments of the invention may have 1, 2, 3, 4, 5, 6, or 7 reactors arranged in series or parallel.

In embodiments of the invention, reactor 103-1 is a radial flow moving bed reactor, in which feed mixture 102 flows radially through reactor 103-1 while catalyst 104 moves vertically downward through reactor 103-1. In this way, feed mixture 102 flows perpendicularly or substantially perpendicularly to movement of catalyst 104 in reactor 103-1. To implement this perpendicular or substantially perpendicular flow, method 20 may involve, at block 202, adding particles of catalyst 104 at catalyst entry location(s) 103-1A of reactor 103-1. Block 203 may then involve allowing particles of catalyst 104 to move slowly by gravity through the radial flow moving bed reactor to exit location(s) 103-1B of reactor 103-1. As FIG. 1 shows, catalyst entry location(s) 103-1A of reactor 103-1 are vertically above exit location(s) 103-1B of reactor 103-1. The movement, by gravity, of particles of catalyst 104 from catalyst entry location(s) 103-1A to exit location(s) 103-1B of reactor 103-1 forms a moving catalyst bed in reactor 103-1.

The gravity flow of catalyst 104 from an upper portion of reactor 103-1 to a lower portion of reactor 103-1 to form a moving catalyst bed and the radial flow of feed mixture 102 embodies block 204 of method 20, which involves flowing feed mixture 102 into reactor 103-1 in a manner so that feed mixture 102 flows radially inward or radially outward through the moving catalyst bed and thereby contacts the catalyst particles under reaction conditions to produce a hydrocarbon stream comprising light olefins ($C_2$ to $C_4$ olefins). The moving catalyst bed, according to embodiments of the invention, has catalyst 104 moving slowly. Hence, the behavior of the moving catalyst bed at each point of reactor 103-1 is similar to a fixed bed reactor. In this way, the radial flow moving catalyst bed implemented according to embodiments of the invention can provide high production capacity without increased pressure drop or increased vessel size while the catalyst remains at an acceptable activity level, by continuous catalyst renewal.

In embodiments of the invention, the reaction conditions in reactor 103-1 include a weight hourly space velocity (WHSV) in a range 1 to 15 $hr^{-1}$, and all ranges and values there between including values 1 $hr^{-1}$, 2 $hr^{-1}$, 3 $hr^{-1}$, 4 $hr^{-1}$, 5 $hr^{-1}$, 6 $hr^{-1}$, 7 $hr^{-1}$, 8 $hr^{-1}$, 9 $hr^{-1}$, 10 $hr^{-1}$, 11 $hr^{-1}$, 12 $hr^{-1}$, 13 $hr^{-1}$, 14 $hr^{-1}$, and 15 $hr^{-1}$, preferably from 2 to 10 $hr^{-1}$ and more preferably from 4 to 9 $hr^{-1}$. With respect to temperature, in embodiments of the invention, the reaction conditions in reactor 103-1 include a reaction temperature in a range 450 to 900° C., and all ranges and values there between including ranges 450 to 475° C., 475 to 500° C., 500 to 525° C., 525 to 550° C., 550 to 575° C., 575 to 600° C., 600 to 625° C., 625 to 650° C., 650 to 675° C., 675 to 700° C., 700 to 725° C., 725 to 750° C., 750 to 775° C., 775 to 800° C., 800 to 825° C., 825 to 850° C., 850 to 875° C., 875 to 900° C., preferably from 530 to 800° C. and more preferably from 580 to 750° C. And with respect to pressure, in embodiments of the invention, the reaction conditions in reactor 103-1 include a pressure in the range vacuum to 10 bars, and all ranges and values there between including values vacuum, 1 bar, 2 bars, 3 bars, 4 bars, 5 bars, 6 bars, 7 bars, 8 bars, 9 bars, and 10 bars. In embodiments of the invention, where water is used as a diluent, the water/hydrocarbon feed volumetric ratio is in the range 0 to 10, and all ranges and values there between including values 0, 1, 2, 3, 4, 5, 6, 7, 8, 9, and 10.

At block 205, method 20 may involve flowing reactor effluent stream 105, comprising light olefin hydrocarbons, from reactor 103-1. In embodiments of the invention, reactor effluent stream 105 may be routed to a second reactor such as reactor 103-2, as shown in FIG. 1 and/or routed to a fractionator (such as fractionator 112, FIG. 1) to separate reactor effluent stream 105 into component parts.

From exit location(s) 103-1B of reactor 103-1, in embodiments of the invention, spent catalyst 106 is withdrawn for regeneration. Consistent with this, method 20 may involve, at block 206, flowing spent catalyst from reactor 103-1 to catalyst regenerator 107. Catalyst regenerator 107 then regenerates spent catalyst 106 to form regenerated catalyst 104, at block 207. The regeneration process may involve burning off carbon deposits (coke) on spent catalyst 106 in catalyst regenerator 107 by the application of heat and air. Block 208 may involve flowing regenerated catalyst 104 from catalyst regenerator 107 to one or more reactors of radial flow moving bed reactor system 103 via, for example, catalyst entry location(s) 103-1A. In embodiments of the invention, an amount of fresh catalyst may be added to supplement regenerated catalyst 104.

In embodiments of the invention where hydrocarbon feed 100 is processed through a series of radial flow moving bed reactors for further processing, method 20 may further include, for example, flowing reactor effluent stream 105 to reactor 103-2. In embodiments of the invention, heater 108 may heat reactor effluent stream 105, prior to feeding reactor effluent stream 105 into reactor 103-2. In embodiments of the invention, reactor 103-2 catalytically cracks reactor effluent stream 105, similar to how reactor 103-1 cracked feed mixture 102. Reaction conditions for reactor 103-2 may be the same as reaction conditions for reactor 103-1 described above. In embodiments of the invention, however, one or more of the described reaction conditions may be varied to take into account a difference in composition of the different influents to each reactor, namely the difference in composition between feed mixture 102 and reactor effluent stream 105. Further, reactor 103-2 may be adapted to operate as reactor 103-1 as described above with respect to flow of the stream being cracked and the catalyst bed.

Thus, in embodiments of the invention, reactor 103-2 may be a radial flow moving bed reactor, in which reactor effluent stream 105 flows radially through reactor 103-2 while catalyst 104 flows vertically downward through reactor 103-2. In this way, reactor effluent stream 105 flows perpendicularly or substantially perpendicularly to catalyst 104 in reactor 103-2. Implementing this perpendicular or substantially perpendicular flow may involve adding particles of catalyst 104 at catalyst entry location(s) 103-2A of reactor 103-2. Method 20 may the involve allowing particles of catalyst 104 to move slowly by gravity through the radial flow moving bed reactor to exit location(s) 103-2B of reactor 103-2. The moving catalyst bed, according to embodiments of the invention, has catalyst 104 moving slowly. As FIG. 1 shows, catalyst entry location(s) 103-2A of reactor 103-2 are vertically above exit location(s) 103-2B of reactor 103-2. The movement, by gravity, of particles of catalyst 104 from catalyst entry location(s) 103-1A to exit location(s) 103-1B of reactor 103-1 forms a moving catalyst bed in reactor 103-2. In embodiments of the invention, reactor 103-2 produces reactor effluent stream 109, which may include more light olefins ($C_2$ to $C_4$ olefins) than in reactor effluent stream 105.

Method 20 may further continue in reactor 103-3, a radial flow moving bed reactor, which operates similar to reactor 103-1 and reactor 103-2, by receiving a hydrocarbon stream, cracking that stream to produce a hydrocarbon stream that has more light olefins than the hydrocarbon stream received by reactor 103-3. For example, FIG. 1 shows heater 110 may heat reactor effluent stream 109, which is then flowed to reactor 103-3, which cracks reactor effluent stream 109 to form reactor system effluent stream 111. In embodiments of the invention, reactor system effluent stream 111 has more light olefins than reactor effluent stream 109.

According to embodiments of the invention, each reactor in the series of radial flow moving bed reactors, other than the first reactor in the series, (e.g., reactor 103-2 and reactor 103-3 of system 10) receives an effluent stream from the prior reactor in the series and processes the effluent stream from the prior reactor in the series to produce an effluent stream including more light olefins than the effluent stream received from the prior reactor in the series. In embodiments of the invention, the process of cracking can be repeated in any number of reactors, as noted above. In embodiments of the invention, one or more of the radial flow moving bed reactors include a catalyst different from a catalyst in the other radial flow moving bed reactors. Further, the configuration of catalysts used in the reactors may be based on the composition of the influent stream to each reactor so as to maximize the conversion to light olefins.

Embodiments of the invention, may include, after cracking in radial flow moving bed reactor system 103 (e.g., one or more of reactors 103-1, 103-2, and/or 103-3), at block 209, fractionating the effluent from radial flow moving bed reactor system 103. For example, as shown in FIG. 1, fractionator 112 fractionates effluent stream 111 from reactor 103-3 to form $C_4$ and lighter olefins stream 113, light naphtha stream 114, full range naphtha 115, and bottom stream 116. In embodiments of the invention, a portion of light naphtha stream 114 and/or a portion of full range naphtha 115 is recycled to be mixed with feed mixture 102 and fed to reactor 103-1. In this way, method 20 may involve, at block 210, recycling uncracked $C_5$ and $C_6$ hydrocarbons back to radial flow moving bed reactor system 103.

It should be noted that, although radial flow moving bed reactor system 103 is shown as a plurality of radial flow moving bed reactors, in embodiments of the invention, radial flow moving bed reactor system 103 may include one reactor, a plurality of reactors in series, a plurality of reactors in parallel, a plurality of reactors that include a reactor other than a radial flow moving bed reactor, and combinations thereof.

According to embodiments of the invention, the gravity flow of the catalyst through one or more radial flow moving bed reactors provides a continuous mode of operation, unlike fixed bed reactors where shutdown is required to reactivate (regenerate) the catalyst to restore its initial activity. In this way, embodiments of the invention may provide high production capacity without increased pressure drop or increased vessel size.

EXAMPLES

As part of the disclosure of the present invention, specific examples are included below. The examples are for illustrative purposes only and are not intended to limit the invention. Those of ordinary skill in the art will readily recognize parameters that can be changed or modified to yield essentially the same results.

Example 1

In Example 1, a test was carried out in which naphtha was cracked catalytically over a fixed bed reactor and a fluidized bed reactor pilot plant. The naphtha feed had the following composition (Table 1):

TABLE 1

| Light Naphtha Composition Feed (LSRN) | |
|---|---|
| N-C5 | 28.8 |
| I-C5 | 11.8 |
| Cycl-C5 | 1.9 |
| N-C6 | 24.5 |
| I-C6 | 26.9 |
| Cycl-C6 | 4.6 |
| Benzene | 1.3 |
| C7 | 0.3 |
| sum | 100 |

Reactor temperature, flow rate, and steam rate are provided in Table 2. Residence time of the fixed bed and the fluidized bed pilot plant was 10 minutes and less than a minute, respectively. The fixed bed had the flexibility to vary the residence time unlike fluid catalytic cracking (FCC) type process, where the residence time was limited to below a minute. As can be seen, in Table 2, the yield for light olefin is higher by approximately 10% when a fixed bed is used. The amount of coke formed was small, which that a moving bed reactor fits very well for this chemistry (e.g., the light naphtha composition).

TABLE 2

| Light Naphtha Cracking Over Fixed And Fluidized Reactors | | |
|---|---|---|
| Reactor Type | Fluidized pilot plant | Fixed-Bed |
| Temperature, C. | 675 | 650 |
| Naphtha, g/h | 240 | 4 |
| Steam, g/h | 60 | 2 |
| Steam, wt % | 25 | 50 |
| Mass Balance | 96 | 98 |
| Conversion,% | 67.7 | 77.5 |
| Yields, wt % | | |
| $C_3^= + C_2^=$ | 34.2 | 44.5 |
| $C_3^=$ | 18.9 | 26.5 |
| $C_2^=$ | 15.3 | 18.1 |
| $C_3^=/C_2^=$ | 1.2 | 1.5 |
| $C_4^=$ | 9.9 | 6.5 |
| $C_5^=$ | | 1.2 |
| BTX | | 1.8 |
| $C_1$-$C_4$ alkanes | 23.6 | 23.5 |
| $C_1$ | 9.1 | 6 |
| $C_2$ | 8.4 | 8.3 |
| $C_3$ | 4.4 | 7.7 |
| $C_4$ | 1.7 | 1.5 |
| $C_5^+$ | 29.1 | 21.4 |
| Others | 2.1 | 0.3 |
| $H_2$ | 0.6 | 0.7 |
| Total | 99.4 | 100 |

Example 2

Impact of Cycles on Catalyst Stability

Figure 3:
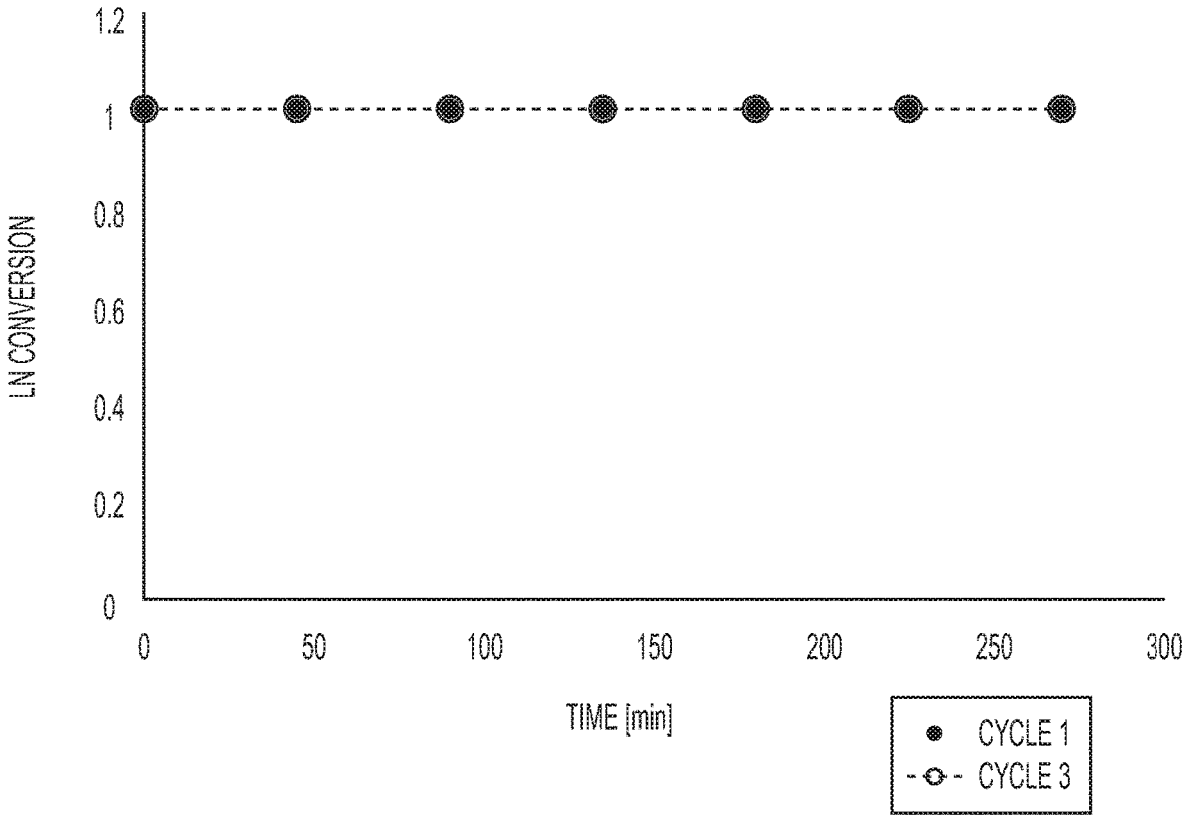
FIG. 3 shows a graph of light naphtha conversion in a catalytic cracking experiment, according to embodiments of the invention.

Example 2 considers that the moving bed ideally should have a stable catalyst over several cycles (reaction-regeneration cycle). FIG. 3 shows the conversion of light naphtha versus time from an experiment in which the conversion took place over three cycles at 650° C., where the catalyst was pure ZSM-5 post treated with phosphorous. As can be seen from FIG. 3, the conversion does not change with time. And the cycles indicate that neither coke nor dealumination was significant enough to cause activity loss. Product distribution, on the other hand, changed over the time.

Example 3

Catalyst Integrity Experiment

Figure 4:
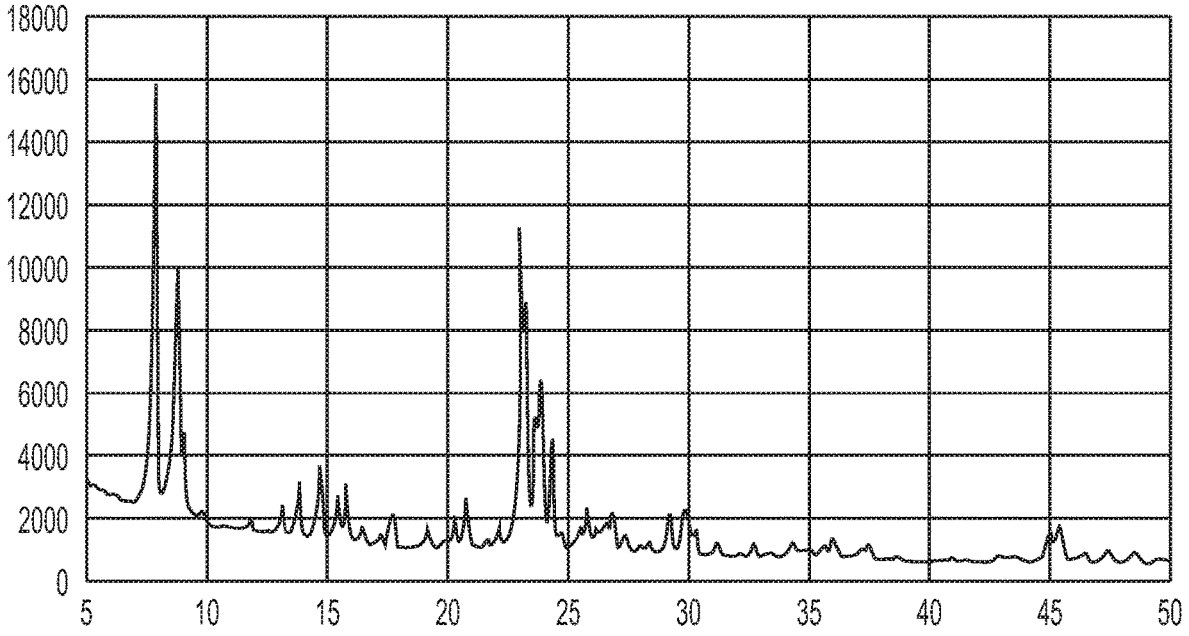
FIG. 4 shows X-ray diffraction (XRD) spectrum of zeolite catalyst after three cycles of catalytic cracking in an experiment, according to embodiments of the invention.

In Example 3, the catalyst integrity was determined in an experiment using XRD after completing three cycles. FIG. 4 shows X-ray diffraction (XRD) spectrum of zeolite catalyst after three cycles. As can be seen in FIG. 4, the XRD pattern shows high crystalline phase of pure ZSM-5 and the absence of any amorphous phase due to steaming or structure damage.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

The invention claimed is:

1. A method of catalytically cracking liquid hydrocarbons, the method comprising: adding catalyst particles to a catalyst entry location of a radial flow moving bed reactor; allowing the catalyst particles to move by gravity through the radial flow moving bed reactor to an exit location of the radial flow moving bed reactor, wherein the catalyst particles form a moving catalyst bed in the radial flow moving bed reactor; mixing a liquid hydrocarbon stream comprising $C_5$ and $C_6$ hydrocarbons with water or a dry gas to form a feed mixture; flowing the feed mixture into the radial flow moving bed reactor in a manner so that the feed mixture flows radially inward or radially outward through the moving catalyst bed and thereby contact the catalyst particles under reaction conditions to produce a hydrocarbon stream comprising light olefins wherein the light olefins comprise $C_2$ to $C_4$ olefins; and flowing the hydrocarbon stream comprising light olefins greater than 50 wt. % $C_2$ and $C_3$ hydrocarbons from the radial flow moving bed reactor.

2. The method of claim 1, further comprising:

flowing spent catalyst from the radial flow moving bed reactor to a catalyst regenerator;

regenerating the spent catalyst in the catalyst regenerator; and flowing regenerated catalyst from the catalyst regenerator to the radial flow moving bed reactor via the catalyst entry location.

3. The method of claim 1, wherein the dry gas comprises hydrogen.

4. The method of claim 1, wherein flowing of the feed mixture is radially outward.

5. The method of claim 1, wherein the liquid hydrocarbon stream has a boiling end point of less than 350° C.

6. The method of claim 1, wherein the reaction conditions comprise a weight hourly space velocity (WHSV) in a range 1 to 15 $hr^{-1}$.

7. The method of claim 1, wherein the reaction conditions comprise a reaction temperature in a range 450 to 900° C.

8. The method of claim 1, wherein the catalyst particles comprise pure ZSM-5 treated with phosphorous.

9. The method of claim 1, wherein the liquid hydrocarbon stream comprises a selection from the list consisting of: light naphtha, heavy naphtha, kerosene, diesel, and combinations thereof.

10. The method of claim 1, further comprising:

recycling uncracked $C_5$ and $C_6$ hydrocarbons back to the radial flow moving bed reactor.

11. The method of claim 1, wherein water/liquid hydrocarbon stream volumetric ratio is in the range 0 to 10.

12. A method of catalytically cracking liquid hydrocarbons, the method comprising: processing a feed stream comprising paraffinic $C_5$ and $C_6$ hydrocarbons mixed in a series of radial flow moving bed reactors, wherein processing in a first radial flow moving bed reactor in the series of radial flow moving bed reactors comprises:

adding catalyst particles to a catalyst entry location of the first radial flow moving bed reactor;

allowing the catalyst particles to move by gravity through the first radial flow moving bed reactor to an exit location of the first radial flow moving bed reactor, wherein the catalyst particles form a first moving catalyst bed in the first radial flow moving bed reactor;

mixing the feed stream with water or dry gas to form a feed mixture;

flowing the feed mixture into the first radial flow moving bed reactor in a manner so that the feed mixture flows radially inward or radially outward through the first moving catalyst bed and thereby contact the catalyst particles under reaction conditions to produce a first hydrocarbon effluent stream comprising greater than 50 wt. % light olefins, wherein the light olefins comprise $C_2$ to $C_4$ olefins;

flowing the first hydrocarbon effluent stream into a second radial flow moving bed reactor of the series of radial flow moving bed reactors for further processing;

flowing spent catalyst from the series of radial flow moving bed reactors to a catalyst regenerator;

regenerating the spent catalyst in the catalyst regenerator; and flowing regenerated catalyst from the catalyst regenerator to the series of radial flow moving bed reactors.

13. The method of claim 12, wherein the catalyst particles comprise pure ZSM-5 treated with phosphorous.

14. The method of claim 12, wherein each reactor in the series of radial flow moving bed reactors, other than the first radial flow moving bed reactor in the series, receives an effluent stream from the prior reactor in the series and processes an effluent stream from the prior reactor in the series to produce an effluent stream comprising more light olefins than the effluent stream from the prior reactor in the series.

15. The method of claim 12, wherein radial flow moving bed reactors in series after the first radial flow moving bed reactor (subsequent reactors) is adapted to operate so that influent for each of the subsequent reactors flows radially inward or radially outward through the each of the subsequent reactors and thereby contact the catalyst particles under reaction conditions to produce a hydrocarbon effluent stream comprising more light olefins than the effluent stream from the prior reactor in the series.

16. The method of claim 12, wherein the dry gas is a selection from the list consisting of: methane ($CH_4$), hydrogen ($H_2$), and combinations thereof.

17. The method of claim 12, wherein flowing the feed mixture radially outward causes the flow of the feed mixture to be perpendicular or substantially perpendicular to movement of the catalyst bed.

18. The method of claim 12, wherein the feed stream comprises a liquid hydrocarbon stream that has an end point of less than 350° C. and at least one of the reactors in the series operate under reaction conditions that comprise a selection from the list consisting of: (1) a weight hourly space velocity (WHSV) in a range from 1 to 15 $hr^{-1}$, (2) a reaction temperature in a range 450 to 900° C., (3) a pressure in a range of vacuum to 10 bars.

19. The method of claim 18, wherein the feed stream comprises a selection from the list consisting of: light naphtha, heavy naphtha, kerosene, diesel, and combinations thereof.

20. A method of catalytically cracking liquid hydrocarbons, the method comprising: processing a feed stream comprising paraffinic $C_5$ and $C_6$ hydrocarbons mixed in a series of radial flow moving bed reactors, wherein processing in a first radial flow moving bed reactor in the series of radial flow moving bed reactors comprises:

adding catalyst particles to a catalyst entry location of the first radial flow moving bed reactor;

allowing the catalyst particles to move by gravity through the first radial flow moving bed reactor to an exit location of the first radial flow moving bed reactor, wherein the catalyst particles form a first moving catalyst bed in the first radial flow moving bed reactor;

mixing the feed stream with water or dry gas to form a feed mixture;

flowing the feed mixture into the first radial flow moving bed reactor in a manner so that the feed mixture flows radially inward or radially outward through the first moving catalyst bed and thereby contact the catalyst particles under reaction conditions to produce a first hydrocarbon effluent stream comprising light olefins, wherein the light olefins comprise $C_2$ to $C_4$ olefins;

flowing the first hydrocarbon effluent stream into a second radial flow moving bed reactor of the series of radial flow moving bed reactors for further processing;

flowing spent catalyst from the series of radial flow moving bed reactors to a catalyst regenerator;

regenerating the spent catalyst in the catalyst regenerator; and flowing regenerated catalyst from the catalyst regenerator to the series of radial flow moving bed reactors, wherein one or more of the radial flow moving bed reactors comprise a catalyst different from a catalyst in the other radial flow moving bed reactors.

* * * * *